United States Patent [19]

Munari et al.

[11] 4,424,862

[45] Jan. 10, 1984

[54] INJECTION DEVICES

[75] Inventors: Georges J. Munari, Le Chesnay; Serge M. Perineau, Paris, both of France

[73] Assignee: Compagnie Francaise des Petroles, Paris, France

[21] Appl. No.: 358,729

[22] Filed: Mar. 16, 1982

[30] Foreign Application Priority Data

Mar. 19, 1981 [FR] France ..... 81 05482

[51] Int. Cl.[3] ..... F21B 34/08; F21B 37/06

[52] U.S. Cl. ..... 166/168; 166/169; 166/305 R; 166/325

[58] Field of Search ..... 166/168, 305 R, 162, 166/169; 251/127; 138/42; 175/308; 166/99, 325–328

[56] References Cited

U.S. PATENT DOCUMENTS 2,238,701 4/1941 McCollum ..... 166/266

2,358,920 9/1944 Garrison ..... 166/266

*Primary Examiner*—Stephen J. Novosad

*Assistant Examiner*—Thuy M. Bui

*Attorney, Agent, or Firm*—Sughrue, Mion, Zinn, Macpeak, and Seas

[57] ABSTRACT

The invention relates to a device for injecting a liquid product, at a low flow rate, into the bottom of a hydrocarbon-producing well. The device comprises an injection valve and, above the injection valve, at least one settling tank through which the liquid to be injected must pass before arriving at the injection member.

3 Claims, 3 Drawing Figures

INJECTION DEVICES

The invention relates to an injection device which is intended to be placed at the bottom of an injection tube for introducing a liquid product, at a low flow rate, into the bottom of a hydrocarbon-producing well, particularly but not exclusively for the purpose of providing protection against corrosion or against hydrates.

Such a device comprises an injection member consisting, for example, of an adjusted valve or a calibrated orifice.

It is found in practice that the injection member rapidly becomes obstructed, as a result of which the injection pressure increases and then injection becomes impossible.

According to the present invention there is provided an injection device adapted to be located at the lower end portion of an injection tube descending into a hydrocarbon-producing well, for introducing a liquid product, at a low flow rate, into the bottom of the well, the injection device comprising an injection member of the adjusted valve or calibrated orifice type, and above the injection member, at least one settling tank through which liquid to be injected flows before arriving at said injection member.

Preferably, the injection device comprises two superposed settling tanks.

The or each settling tank is advantageously provided inside a tubular section which is screwed at its upper part to a supporting mandrel and at its lower part to a body in which the injection member is housed.

In the preferred embodiment, the tubular section is provided with an internal shoulder in its upper part and two internal cylindrical bearing surfaces, comprising a first internal cylindrical bearing surface above the shoulder and a second internal cylindrical bearing surface, the diameter of which is less than that of the first internal cylindrical bearing surface, in its lower part. Two settling tanks are provided by two superposed cylinders joined to one another. The cylinders comprise an upper cylinder closed at its lower end, open at its upper end, where it ends in an external shoulder which is surmounted by a first external cylindrical leak-tight bearing surface means, the diameter of which corresponds to that of the first internal cylindrical bearing surface, and provided with lateral orifices below the external shoulder, and a lower cylinder, the diameter of which is less than that of the upper cylinder, open at its lower end, where it is provided with a second external cylindrical leak-tight bearing surface means, the diameter of which corresponds to that of the second internal cylindrical bearing surface, and closed at its upper end, where it is provided with lateral orifices. The combined lengths of the two cylinders are such that, when the external shoulder of the upper cylinder rests on the internal shoulder of the tubular section, the second external cylindrical leak-tight bearing surface means of the lower cylinder engages in the second internal cylindrical bearing surface of the tubular section, a space then remaining free between the tubular section and the two cylinders, along the length of the cylinders, from the external shoulder to the second external cylindrical lead-tight bearing surface means.

An embodiment of the injection device according to the invention will now be described, by way of example only, with reference to the attached drawing.

Figure 1:
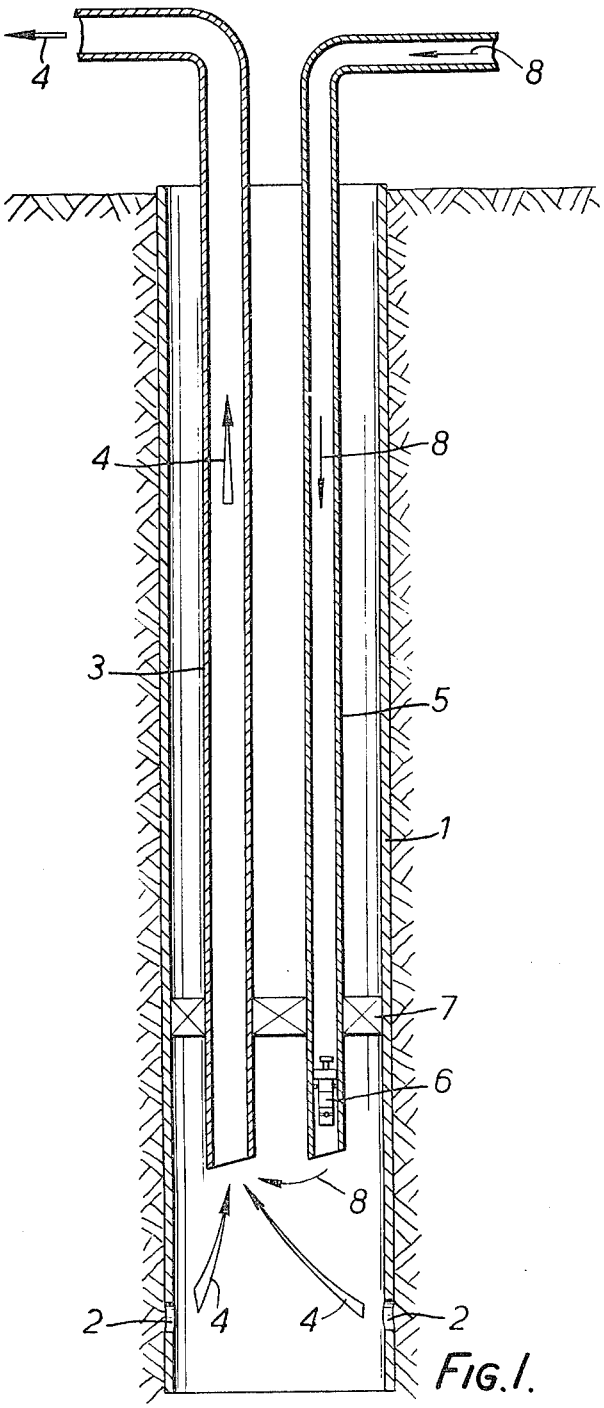
FIG. 1 shows, very diagrammatically, a vertical section through a petroleum well, showing the location of an embodiment of an injection device according to the present invention.

In FIG. 1, a petroleum well, delimited by a casing 1 provided in its lower part with perforations 2 for the passage of the effluent, contains a production tube 3 in which the effluent rises in the direction of the arrows 4, an injection tube 5 descending into the well and provided in its lower part with an injection device 6, and a leak-tight packing 7, referred to as a "packer", between the tubes 3 and 5 and the casing 1. The injection device 6 is applied in a leak-tight manner against a shoulder of the injection tube 5, and it can be raised to the surface by cable recovery according to the so-called "wire line" technique. The product being injected flows in the direction of arrows 8.

Figure 2:
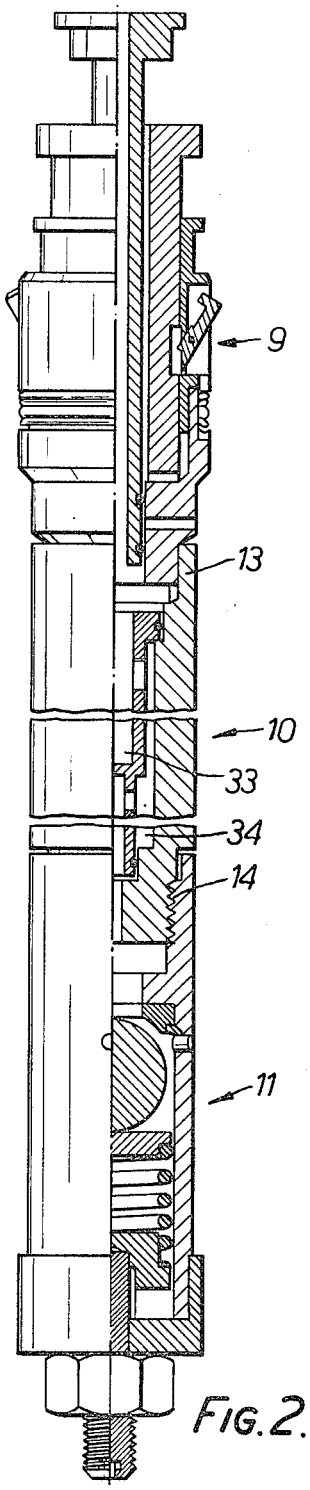
FIG. 2 shows the injection device in elevation and half-section, on a larger scale.

The injection device 6 which is shown in detail in FIG. 2 comprises three successive parts in the longitudinal direction, namely an upper part 9 forming a supporting mandrel, an intermediate part 10 containing settling tanks, and a lower part 11, the body of which contains a check-valve with a calibrated spring. The parts 9 and 11 are in themselves conventional and will not therefore be described in detail.

Figure 3:
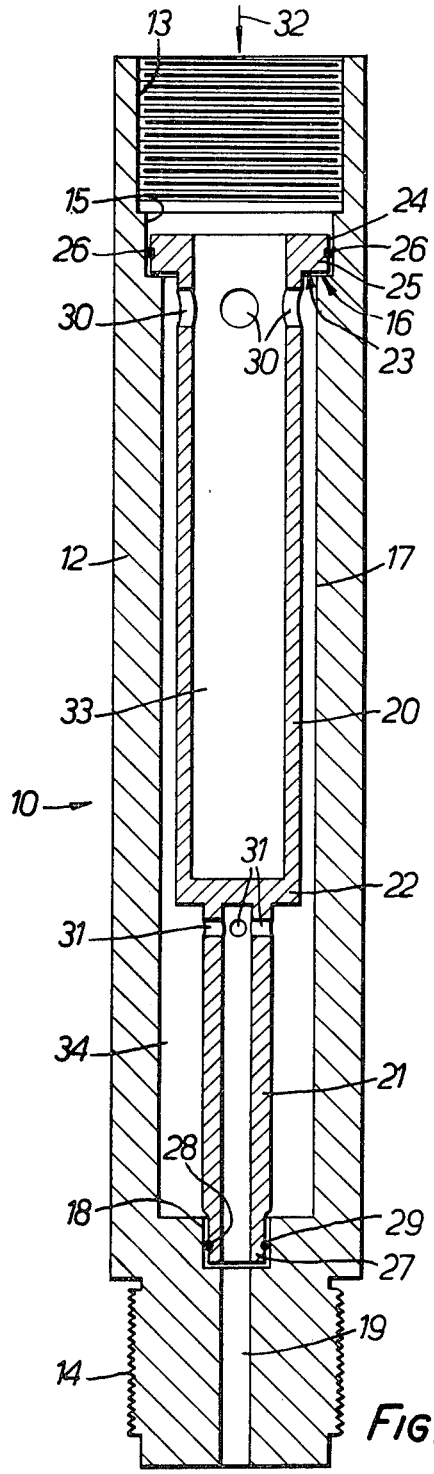
FIG. 3 shows, on an even larger scale, a vertical section through a portion of the injection device which contains the settling tanks.

Part 10 will be described in detail, particularly with reference to FIG. 3. Part 10 comprises a tubular section 12 which serves as an envelope for the part and which is connected at its upper end to the part 9 by an internally threaded portion 13 and at its lower end to the part 11 by an externally threaded portion 14. On the inside, running from top to bottom the tubular section 12 has a first internal cylindrical bearing surface 15 ending at an internal shoulder 16, followed by a long cylindrical wall 17, and then a double constriction successively forming a second internal cylindrical bearing surface 18 and a passage 19 which opens into the part 11.

Two settling tanks 33, 34 are provided by two superposed cylinders, namely an upper cylinder 20 open at the top, and a lower cylinder 21 open at the bottom, these two cylinders being joined to one another by a circular plate 22 which closes them at their adjacent ends, namely their lower and upper ends respectively. The upper cylinder 20 is provided in its upper part with an external shoulder 23 surmounted by an external cylindrical bearing surface 24 in which a groove 25, serving to accommodate an O-ring seal 26, has been made. The lower cylinder 21, the diameter of which is less than that of the upper cylinder 20, is provided in its lower part with an external cylindrical bearing surface 27 in which a groove 28, serving to accommodate an O-ring seal 29, has been made. The diameters of the external cylindrical bearing surfaces 24 and 27 correspond respectively to the diameters of the internal cylindrical bearing surfaces 15 and 18, and these bearing surfaces are applied respectively against one another, when the shoulder 23 comes onto the shoulder 16, in a leak-tight manner.

The cylinders 20 and 21 are provided with lateral orifices, 30 and 31 respectively, in their upper parts, so that liquid product to be injected, which flows into part 10 in the direction of the arrow 32, passes first through the settling tank 33 formed by the cylinder 20, and then through the settling tank 34 formed between the cylindrical wall 17 and the cylinder 21, before passing into cylinder 21 and through the passage 19 via the orifices 31.

This arrangement with a double settling tank is a preferred arrangement, but it would also be possible to provide only one tank, for example by providing only the cylinder 21 and by dispensing with the cylinder 20, or, by providing only the cylinder 20 and by dispensing with the cylinder 21. Numerous variants can be adopted in the construction of the or each settling tank. It would be possible, in particular if a single settling tank were provided, to attach a deflector bell thereto, ensuring that the injected liquid follows a deflected course which assists the deposition of sediments in the settling tank.

An injection device as described above has been found to operate perfectly over a test period of several months.

What is claimed is:

1. An injection device adapted to be located at the lower end portion of an injection tube descending into a hydrocarbon-producing well, for introducing a liquid product, at a low flow rate, into the bottom of the well, said injection device comprising an injection valve member, and, coupled to the upper part of said injection member, at least one settling tank through which liquid to be injected flows before arriving at said injection member.

2. A device according to claim 1, comprising a supporting mandrel, a body in which said injection member is housed, and a tubular section in which said settling tank is provided, wherein said tubular section is screwed at its upper part to said supporting mandrel and at its lower part to said body.

3. A device according to claim 2, wherein said tubular section is provided with an internal shoulder in its upper part, a first internal cylindrical bearing surface above said shoulder, and a second internal cylindrical bearing surface, the diameter of which is less than that of said first internal cylindrical bearing surface, in its lower part, and two settling tanks are provided by an upper and a lower cylinder joined to one another, said upper cylinder being closed at its lower end and open at its upper end where it is provided with an external shoulder which is surmounted by a first external cylindrical leak-tight bearing surface means, the diameter of which corresponds to that of said first internal cylindrical bearing surface, and with lateral orifices below said external shoulder, said lower cylinder, the diameter of which is less than that of said upper cylinder, being open at its lower end where it is provided with a second external cylindrical leak-tight bearing surface means, the diameter of which corresponds to that of said second internal cylindrical bearing surface, and being closed at its upper end where it is provided with lateral orifices, the combined lengths of said two cylinders being such that, when said external shoulder of said upper cylinder rests on said internal shoulder of said tubular section, said second external cylindrical leak-tight bearing surface means of said lower cylinder engages in said second internal cylindrical bearing surface of said tubular section, a space remaining free between said tubular section and said two cylinders, along the latter, from said external shoulder to said second external cylindrical leak-tight bearing surface means.

* * * * *